United States Patent [19]

Simo-Company

[11] Patent Number: 4,605,250

[45] Date of Patent: Aug. 12, 1986

[54] INTERNAL BRAKE FOR DOORS

[76] Inventor: Angel Simo-Company, Urb. Santa Paula, Calle Géminis, Qta. "Aleromay", El Cafetal, Caracas 1062, Venezuela

[21] Appl. No.: 762,792

[22] Filed: Aug. 2, 1985

Related U.S. Application Data

[63] Continuation-in-part of Ser. No. 447,890, Dec. 8, 1982, abandoned.

[51] Int. Cl.[4] ..... E05C 1/12

[52] U.S. Cl. ..... 292/171; 292/DIG. 15

[58] Field of Search ..... 292/171, DIG. 15; 411/32, 33, 542

[56] References Cited

U.S. PATENT DOCUMENTS

| | | | |
|---|---|---|---|
| 558,786 | 4/1896 | Doyle | 292/DIG. 15 |
| 833,024 | 10/1906 | Clark | 292/171 |
| 1,196,685 | 8/1916 | Heatherbell et al. | 292/171 |
| 1,518,613 | 12/1924 | Teeter | 292/DIG. 15 |
| 1,590,394 | 6/1926 | Rawlings | 292/DIG. 15 |
| 1,944,382 | 3/1931 | Wecker | 292/171 X |
| 2,046,790 | 7/1936 | Phillips | 292/171 X |
| 2,726,109 | 12/1955 | Bennett | 292/DIG. 15 |

FOREIGN PATENT DOCUMENTS

| | | | |
|---|---|---|---|
| 822057 | 11/1951 | Fed. Rep. of Germany | 292/171 |
| 16241 | of 1900 | United Kingdom | 292/DIG. 15 |
| 199922 | 7/1923 | United Kingdom | 292/DIG. 15 |

*Primary Examiner*—Robert L. Wolfe
*Assistant Examiner*—Lloyd A. Gall
*Attorney, Agent, or Firm*—Karl F. Ross; Herbert Dubno

[57] ABSTRACT

An internal door brake having a friction member biased downwardly by a spring to engage the floor beneath the door at any location thereof, the friction member being retractable by the rotation of the doorknob, to which the member is connected by a cable, and the provision of a pin extendable through the wall of the door and displaceable for engagement in a recess formed in the friction member when the member is in a retracted position for maintaining the member in a retracted position out of engagement with the floor, so that the door can be freely swung.

3 Claims, 2 Drawing Figures

INTERNAL BRAKE FOR DOORS

This is a continuation-in-part of application Ser. No. 447,890 filed on Dec. 8, 1982, now abandoned.

FIELD OF THE INVENTION

This invention refers to an internal brake for doors, which can be actuated by the doorknob thereof.

SUMMARY OF THE INVENTION

This device according to the invention comprises a compact plunger made of solid metallic washers, intercalated with rubber washers, this plunger having at its lower end a rubber butt, which is in contact with the floor when the brake is actuated, such plunger being connected to a long metallic cable, which goes directly through the other parts up to the shaft of the doorknob, or to any other device used to actuate the brake. The foregoing described plunger is placed inside a housing, which acts as a cover and guide for the plunger, perfectly nested inside, the rubber washers preventing it from moving from side to side, this protective housing having at its lower end flat oppositely extending flanges having four holes in order to screw it on to the bottom edge of the door. Above the plunger is disposed a spring, which operates to bear against the plunger to make the brake function. Such spring is protected by a sleeve in which it nests, the sleeve being mounted on the top of the housing, the upper end of the sleeve being connected to an internally threaded seat, in which a screw or threaded sleeve is provided to guide the metallic cable coming from the plunger and which goes through all of the other elements, until reaching the actuator. This metallic cable is protected with a double metallic and plastic jacket.

The functioning of the device is produced by means of the actuator, a lock or any other appliance, or similar element provided in the door directly above the brake, with little movement of the actuator, the metallic cable pulling the plunger, which is in contact with the floor biased by the spring, upwardly enabling the door to move normally, but if the actuator is not moved, the pressure which the spring exercises over the plunger would keep it down in contact with the floor, braking the door.

This appliance has an auxiliary piece which serves to neutralize the brake, consisting of a button connected to a pin which is inserted externally in the door and which extends through the housing into a recess in the plunger, and which keeps the brake disengaged when it is wished to.

An important feature of this invention is the perfect fitting of all its parts, thus achieving a complete immobilization of the door, with no movements or noise. The great advantage of this invention is its internal placement, which does not affect the appearance of the door itself.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
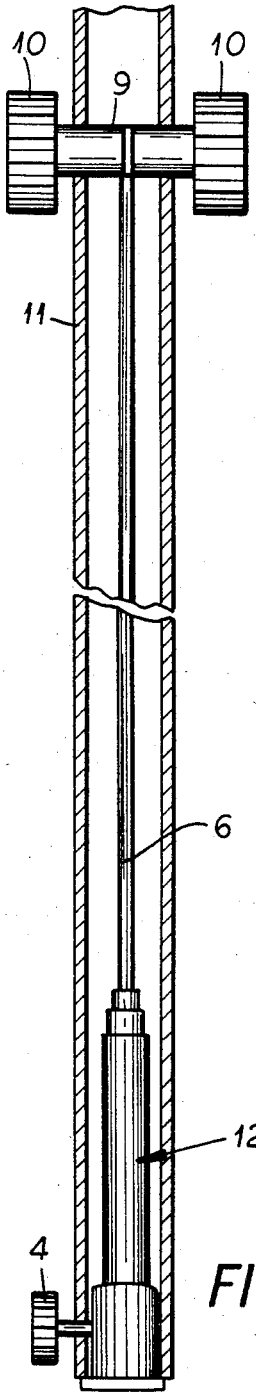
FIG. 1 is an elevational view of the device in place in a door.

In FIG. 1 the appliance is shown placed into a door 11 without the brake 12 having been actuated into the retracted position, but all of the external elements which conform to it can be easily observed, as well as the way they are connected, plus the pin device 4 which maintains the plunger 1 in a retracted position. The plunger 1 is formed by the washers 2 and 3 and the rubber butt 5, which is the one contacting the floor when the brake 12 is actuated, this element along with the metallic cable 6 being the most important elements of this appliance, the rest being auxiliary pieces. The sleeve 7 contains the spring 8 which operates to make the brake extend from the housing. The metallic cable 6 extends from the plunger 1 to the actuator, which would be in this case the shaft 9 of the doorknob 10 positioned directly above the brake 12 and around which cable 6 is wound and pulled upwardly when doorknob 10 is turned.

Figure 2:
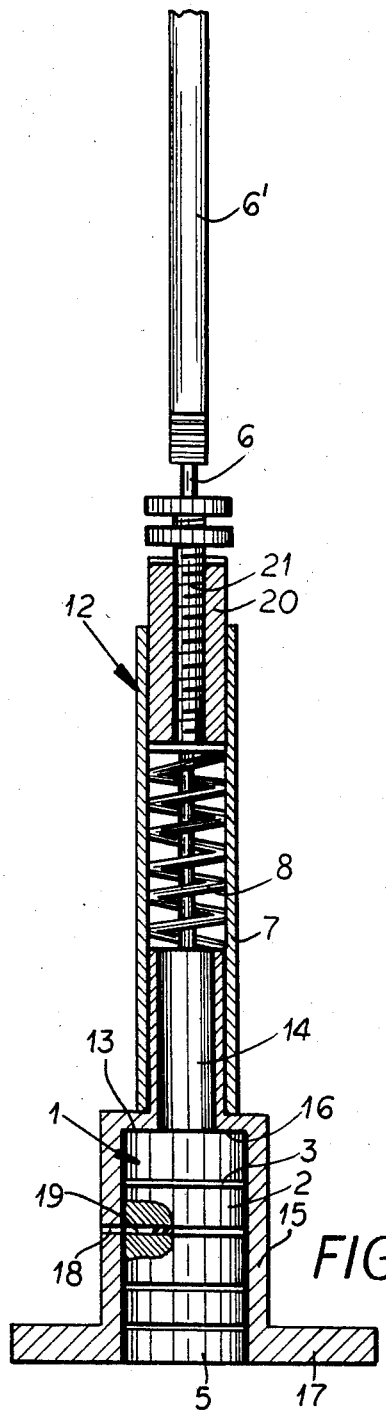
FIG. 2 is an axial sectional view of the device according to the invention shown in the retracted position thereof.

In FIG. 2 is shown a longitudinal sectional view of the appliance in which it is possible to see each and every element comprising the brake 12, starting from the plunger 1 made of solid metallic washers 2, intercalated with rubber washers 3 and having a step 13 and a projection 14 extending into sleeve 7 and against which the spring 8 bears, the rubber butt 5 being in contact with the floor when the brake 12 is actuated, the plunger 1 going up or down when the actuator is moved. The metallic cable 6 is connected to the rubber butt 5, and continues upwardly to the actuator, passing through the rest of the elements of plunger 1, causing same to act as a unit against the force of spring 8 The plunger 1 is protected by a housing 15 having a shoulder 16 coacting with step 13 to limit the upward movement of plunger 1, the housing 15 having flanges 17 provided with four openings for screws in order to fix the device 12 to the bottom edge of the door 11. The housing 15 also has another opening 18, where the pin device 4 enters the recess 19 in plunger 1. The spring 8 bears on projection 14 and thereby exercises pressure over the plunger 1, this spring 8 being protected by the sleeve 7, which is mounted on housing 15 and is provided with an internally threaded seat 20 where a screw 21 having a throughgoing axial bore is threaded in order to guide the metallic cable 6 so as to have it make vertical, but not horizontal movements.

Fron this point on, such metallic cable 6 is protected by a double metal and plastic jacket 6', until reaching the actuator, which could be the door's lock or any other similar device which can pull upwardly on cable 6, an example being the doorknob 10 in FIG. 1.

I claim:

1. An internal door brake comprising:

a door having at least a portion thereof formed with a hollow interior;

a rotatable doorknob provided on said door and having a shaft extending into the hollow portion thereof;

a vertically displaceable plunger provided at the bottom edge of said door directly below said doorknob, said plunger being formed with an inwardly directed step having a projection extending upwardly therefrom, the bottom end of said plunger being provided with a butt of elastomeric material adapted to engage the floor beneath said door;

a housing around said plunger forming a guide therefor and having a shoulder engageable with said step for limiting the upward movement of said plunger, said housing being formed with oppositely extending flanges at the lower end thereof engageable with the bottom edge of said door for fixing said housing thereto;

a sleeve provided at the upper end of said housing and extending upwardly from said shoulder around said projection;

a seat in said sleeve spaced from said projection;

a spring disposed between said seat and said projection for biasing said plunger into egagement with said floor;

a cable connected to said plunger and extending axially upwardly through said spring and said seat and connected to said shaft whereby upon rotation of said doorknob said plunger is vertically displaced out of engagement with said floor; and a pin extending through a wall of said door and said housing and being radially displaceable for engagement in a recess formed in said plunger when said plunger is retracted against said shoulder for maintaining said plunger in a retracted position out of engagement with said floor, said plunger being formed by a plurality of intercalated metal and elastomeric washers, said elastomeric washers contacting the internal walls of said housing for preventing the introduction therein of foreign particles and lateral movement of the plunger.

2. The brake defined in claim 1 wherein the portion of said cable extending upwardly from said seat is provided with a protective sheath.

3. The brake defined in claim 2 wherein said seat is formed axially with a threaded bore provided with a threaded screw through which said cable passes, said threaded screw being vertically adjustable to meet said sheath for providing a guide for said cable.

* * * * *